United States Patent [19]

Tsujimoto et al.

[11] Patent Number: 4,561,000

[45] Date of Patent: Dec. 24, 1985

[54] HEAT-SENSITIVE RECORDING UNIT

[75] Inventors: Michihiro Tsujimoto, Tachikawa; Makoto Asano, Yokohama; Kiyoharu Hasegawa, Kamakura; Hiroyuki Akahori, Yokosuka, all of Japan

[73] Assignee: Mitsui Toatsu Chemicals, Inc., Tokyo, Japan

[21] Appl. No.: 557,181

[22] PCT Filed: Aug. 2, 1983

[86] PCT No.: PCT/JP83/00250

§ 371 Date: Dec. 1, 1983

§ 102(e) Date: Dec. 1, 1983

[30] Foreign Application Priority Data

Jul. 27, 1983 [JP] Japan ..... 58-135695

[51] Int. Cl.[4] ..... B41M 5/18

[52] U.S. Cl. ..... 346/208; 346/202; 346/209; 346/224; 427/150

[58] Field of Search ..... 346/200, 202, 208, 209, 346/224; 427/150, 151, 152

[56] References Cited

U.S. PATENT DOCUMENTS 4,398,753 8/1983 Asano et al. ..... 346/224

FOREIGN PATENT DOCUMENTS 0055847 7/1982 European Pat. Off. ..... 346/224
51-43786 11/1976 Japan ..... 346/202
0027782 2/1982 Japan ..... 346/224

*Primary Examiner*—Bruce H. Hess
*Attorney, Agent, or Firm*—Fisher, Christen & Sabol

[57] ABSTRACT

A heat-sensitive recording unit formed by supporting a methine-type chromogenic reactant and oxidizing organic compound on a base. A color production sensitivity regulator may further be supported on the base. It is also feasible to add a quaternary ammonium salt, tertiary alkanol amine or water-soluble ion sequestering agent for avoiding undesirable color production of the methine-type chromogenic reactant. The ammonium salt, amine or ion sequestering agent may be added upon forming the methine-type chromogenic reactant into an aqueous suspension in order support the methine-type chromogenic reactant on the base.

10 Claims, No Drawings

HEAT-SENSITIVE RECORDING UNIT

TECHNICAL FIELD

This invention relates to a novel heat-sensitive recording unit making use of production of a color by a novel oxidation-reduction reaction. More specifically, it relates to a heat-sensitive recording unit comprising, as essential components, a methine-type chromogenic reactant and an oxidizing organic compound supported on a base.

BACKGROUND ART

A variety of methods has heretofore been proposed as to the heat-sensitive recording system which provides a record of images or marks by utilizing a physical or chemical change that a substance undergoes under the influence of thermal energy. Among these heat-sensitive recording methods, the so-called chromogenic reactant based color production-type heat-sensitive recording method and heat-sensitive recording paper making use of the recording method, which are proposed in Japanese Patent Publicattion No. 14039/1970, etc., have found wide-spread commercial utility in output console units such as computer console units and facsimiles, reflecting recent technical advancement in thermal printers led by the development of thermal heads making use of resistor elements, because the above particular heat-sensitive recording method is free of such problems as noise and offensive odor and it permits high-speed recording. Accordingly, the chromogenic reactant based color production-type heat-sensitive recording method and heat-sensitive recording paper which makes use of the above recording method are expected to find still more acceptance in the future.

These chromogenic reactant based color production-type heat-sensitive recording paper are each formed, generally speaking, of (A) a lactone-type chromogenic reactant, for example, 3-bis(4-dimethylaminophenyl)-6-dimethylaminophthalide (Crystal Violet Lactone) and (B) an acidic substance, for example, a phenolic compound such as 2-bis(4-hydroxyphenyl)propane (bisphenol A), which are supported together with a binder and other additives on a base. An application of heat causes at least one of the reactants (A) and (B) to melt and the reactants (A) and (B) are hence allowed to contact with each other, thereby forming a color image or mark with the thus-acidified lactone-layer chromogenic reactant on the base.

Heat-sensitive recording paper making use of the color production by the contact of a lactone-type chromogenic reactant and an acidic phenolic compound is however accompanied by the following serious problems:

(1) It is necessary to carry a chromogenic reactant and its matching color-developing agent both in large amounts on a base if one wants to obtain a color image or mark having sufficient density. A lot of energy is thus required to melt either one or both of the chromogenic reactant and color-developing agent so as to bring them into mutual contact, thereby making the heat-sensitive recording paper difficult to meet the recent trend toward still faster recording in data communication (facsimiles); and (2) Color images or marks, which are obtained by the reaction between an chromogenic reactant and color-developing agent when either one or both of the chromogenic reactant and color-developing agent are melted by heat, are extremely unstable and are susceptible of undergoing easy discoloration or fading upon exposure to light, whereby making the color images or markes illegible. Furthermore, such color images or marks readily disappear upon contact with an oil or the like.

There is a strong outstanding demand for the improvement to these problems in the above heat-sensitive recording method which is expected to become the dominant method in facsimiles which have been finding more and more acceptance in recent years. A variety of extensive researches and investigations have been made in recent years with respect to chromogenic reactants, color-developing agents, additives and coating formulations for heat-sensitive recording paper. Under the circumstances, none of such researches and investigations appear to have resulted in any breakthrough improvement.

DISCLOSURE OF THE INVENTION

An object of this invention is to provide a heat-sensitive recording unit capable of providing a color image or mark which is extremely stable to the environment, does not undergo easy discoloration or fading upon exposure to light, and does not readily disappear even when brought into contact wih an oil or the like.

Another object of this invention is to provide, in order to achieve the aforementioned object of this invention, a novel heat-sensitive recording unit relying upon a color production system which makes use of an oxidation-reduction reaction between a methine-type chromogenic reactant and an oxidizing organic compound.

These objects of the present invention can be attained by the following heat-sensitive recording unit:

A heat-sensitive recording unit comprising a methine-type chromogenic reactant represented by the following general formula (I):

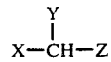

(I)

wherein X, Y and Z may be the same or different and mean individually a substituted or unsubstituted phenyl, naphthyl, $\beta$-styryl or aromatic heterocyclic residual group, two of X, Y and Z may be coupled together to form a ring, and the substituted or unsubstituted phenyl, naphthyl or $\beta$-styryl group has at least one amino, substituted amino or lower alkoxyl group at the para-position relative to the central methine group of the molecule when one or none of X, Y and Z is the aromatic heterocyclic residual group and an oxidizing organic compound, both, supported on a base.

The above heat-sensitive recording unit is totally different from conventional color systems which relied upon acid-base reactions between lactone-type chromogenic reactants and acidic substances and has solved the above-described various problems of conventional heat-sensitive recording paper of the chromogenic reactant based color production type.

The main feature of the heat-sensitive recording unit according to this invention resides in that, although conventional heat-sensitive recording units provide or form color images or marks by the equilibrium reactions between acids (acidic color-developing agents represented by bisphenols) and bases (lactone-type chromogenic reactants led by CVL), i.e., in accordance with the following chemical equation:

Acidic color-developing agent

+ ⇌ Color images or marks.

Basic chromogenic reactant the heat-sensitive recording unit of this invention makes use of an oxidation-reduction reaction which is considered to proceed substantially in a non-reversible fashion, namely, which is expressed as follow:

Oxidizing organic color-developing agent

+ → Color images or marks.

Methine-type chromogenic reactant

In the heat-sensitive recording unit according to this invention, color images or marks formed on the base thereof by heating the unit and allowing the reactants to contact with each other are extremely stable to the environment.

BEST MODE FOR CARRYING OUT THE INVENTION

Methine-type chromogenic reactants useful in the present invention are a group of compounds represented by the above general formula (I). As illustrative aromatic heterocyclic residual groups represented by X, Y and/or Z, may be mentioned those having the following basis structures:

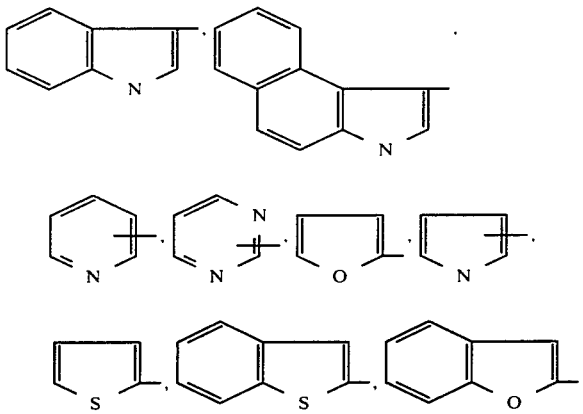

It should however be borne in mind that the aromatic heterocyclic residual groups are not limited to those given above.

In addition, as substituent groups which may be bonded to carbon and/or hetero atoms of the phenyl, naphthyl, β-styryl or aromatic heterocyclic residual group, may, for example, be mentioned halogen atoms; lower alkyl groups; halogenated lower alkyl groups; cycloalkyl groups; lower alkoxy groups; acyl group; carboalkoxy groups; cyanoalkyl groups; cyano group; hydroxyl group; nitro group; substituted or unsubstituted aralkyl, phenyl, aryloxy, aralkylalkoxy and amino groups; substituted amino groups containing, as substituent group or groups, one or two lower alkyl, cycloalkyl, cyanoalkyl, halogenated alkyl, hydroxyalkyl, substituted or unsubstituted aryl, or substituted or unsubstituted aralkyl groups; polymethyleneamino groups (for example, pyrrolidino and piperidino groups); and morpholino group. Two of such substituent groups may be coupled together to form a ring.

Specifically speaking, the following compounds may be mentioned:

(A) Triaminotriphenylmethane-type chromogenic reactants:

4,4',4"-tris-dimethylamino-triphenylmethane;
4,4',4"-tris-diethylamino-triphenylmethane;
4,4'-bis-methylamino-4"-dimethylamino-triphenylmethane;
4,4'-bis-dimethylamino-4"-methylamino-triphenylmethane;
4,4'-bis-diethylamino-4"-ethylamino-triphenylmethane;
4,4'-bis-diethylamino-4"-amino-triphenylmethane;
4,4'-bis-dimethylamino-3"-methyl-4'-amino-triphenylmethane;
4,4'-bis-dimethylamino-3"-methyl-4"-methylamino-triphenylmethane;
4,4',4"-trisphenylamino-triphenylmethane;
4,4',4"-tris(N-methyl-N'-phenylamino)-triphenylmethane;
4,4'-bismorpholino-4"-dimethylamino-triphenylmethane;
4,4',4"-tris-dimethylamino-2,2'-dimethyl-triphenylmethane;
4,4',4"-tris-dimethylamino-3,3'-dimethyl-triphenylmethane;
4,4',4"-tris-dimethylamino-2-methoxy-triphenylmethane;
4,4',4"-tris-dimethylamino-3-methyl-triphenylmethane;
4,4'-bis-dimethylamino-4"-N-benzylamino-triphenylmethane;
4,4'-bis-dimethylamino-4"-N-benzylamino-3'-methoxy-triphenylmethane;
4,4'-bis-dimethylamino-4"-N-benzylamino-3"-methyl-triphenylmethane;
4,4'-bis-dimethylamino-3'-chloro-4'-N-benzylaminotriphenylmethane;
4,4'-bis-dimethylamino-4"-(N-benzyl-N-methylamino)-triphenylmethane;
4,4'-bis-dimethylamino-4"-(N-o-chlorobenzyl-N-methylamino)-triphenylmethane;
4,4'-bis-dimethylamino-4"-(N-p-chlorobenzyl-N-methylamino)-triphenylmethane;
4,4'-bis-dimdethylamino-4"-(N-p-methylbenzyl-N-methyl)-triphenylmethane;
4,4'-bis-dimethylamino-4"-(N,N-dibenzylamino)-triphenylmethane;
4,4'-bis-dimethylamino-4"-(N-phenyl-N-methylamino)-triphenylmethane;
4,4'-bis-dimethylamino-4"-morpholino-triphenylmethane;
4,4'-bis-N-benzylamino-4"-dimethylamino-triphenylmethane; 4,4'-bis-(N-benzyl-N-methylamino)-4"-dimethylaminotriphenylmethane;
4,4'-bis-(N-parachlorobenzyl-N-methylamino)-4"-dimethylamino-triphenylmethane;
4,4'-bis(N-parabromobenzyl-N-ethylamino)-4"-diethylamino-triphenylmethane;
4,4'-bis-pyrrolidyl-4"-dimethylaminotriphenylmethane;
4,4'-bis(N-orthochlorobenzyl-N-methylamino)-4"-dimethylamino-triphenylmethane;
4,4'-bis-pyrrolidyl-4"-(N-benzyl-N-methylamino)-triphenylmethane;

3,3'-dichloro-4,4'-bis(N-benzylamino)-4''-dimethylamino-triphenylmethane;
4,4'-bis(N-p-methylbenzyl-N-methylamino)-4''-dimethylamino-triphenylmethane;
4,4'-bis(N-p-methylbenzyl-N-ethylamino)-4''-diisopropylamino-triphenylmethane;
3,3'-dimethyl-4,4'-bis(p-methylbenzylamino)-4''-dimethylaminotriphenylmethane;
3,3'-dimethyl-4,4'-bis(N-benzylamino)-4''-dimethylamino-triphenylmethane;
3,3'-dibutyl-4,4'-bis-N-benzylamino-4''-diethylamino-triphenylmethane;
etc.

(B) Diaminotriphenylmethane-type chromogenic reactants:
4,4'-bis-dimethylamino-triphenylmethane;
4,4'-bis-dimethylamino-4''-methyl-triphenylmethane;
4,4'-bis-(N-benzyl-N-ethylamino)triphenylmethane;
4,4'-bis-dimethylamino-2-chloro-triphenylmethane;
4,4'-bisdiisopropylamino-3''-bromotriphenylmethane;
4,4'-bisdimethylamino-4''-methoxytriphenylmethane;
4,4'-bisdimethylamino-4''-ethoxytriphenylmethane;
4,4'-bisdimethylamino-3''-methyl-4''-methoxytriphenylmethane;
4,4'-bisdimethylamino-3''-methyl-4''-ethoxytriphenylmethane;
4,4'-bisdimethylamino-3'',4''-dimethoxytriphenylmethane;
4,4'-bisdimethylamino-2'',4''-dimethoxytriphenylmethane;
4,4'-bis-diethylamino-3''-ethyl-4''-ethoxytriphenylmethane;
4,4'-bis-methylamino-3,3'-dimethyl-3''-butyl-4''-butoxytriphenylmethane;
4,4'-bis-dimethylamino-3''-cyclohexyl-4''-methoxytriphenylmethane;
4,4'-bis-propylamino-3''-phenyl-4''-propoxytriphenylmethane;
4,4'-bis(N-benzyl-N-methylamino)-3'-propyl-4''-methoxytriphenylmethane;
4,4'-bis(N-benzyl-N-methylamino)-3''-methyl-4''-ethoxytriphenylmethane;
4,4'-bis-N-pyrrolidyl-3''-methyl-4''-methoxytriphenylmethane;
4,4'-bis-N-piperidyl-3''-methyl-4''-ethoxytriphenylmethane;
4,4'-dimethylamino-3''-tert-butyl-4''-methoxytriphenylmethane;
etc.

(C) Monoaminotriphenylmethane-type chromogenic reactants:
4,4'-dimethoxy-4''-dimethylaminotriphenylmethane;
4,4'-dimethoxy-3''-methyl-4''-methylaminotriphenylmethane;
4,4'-diethoxy-4''-diethylaminotriphenylmethane;
4,4'-dimethoxy-4''-(N-benzyl-N-methylamino)-triphenylmethane;
3,3'-dimethyl-4,4'-dimethoxy-4''-dimethylaminotriphenylmethane;
4,4'-dimethoxy-4''-pyrrolidinotriphenylmethane;
4,4'-dimethyl-4''-diethylaminotriphenylmethane;
4-methoxy-4'-dimethylaminotriphenylmethane;
etc.

(D) Naphthylmethane-type chromogenic reactants:
bis(4-dimethylamino-naphthyl-1)-4'-dimethylamino-phenylmethane;
bis(4-ethylamino-naphthyl-1)-4'-dimethylamino-phenylmethane;
bis(4-N-paratolyl-N-methylamino-naphthyl-1)-4'-isopropylaminophenylmethane;
tris(4-dimethylamino-naphthyl-1)methane;
bis(4-dimethylamino-naphthyl-1)-4'-N-morpholino-phenylmethane;
bis(4-diethylaminophenyl)-4'-N-phenylaminonaphthyl-1'-methane;
bis(4-diethylaminophenyl)-4'-ethylaminonaphthyl-1'-methane;
bis(4-N-phenyl-N-methylaminonaphthyl-1)-β-styrylmethane;
bis(4-dimethylamino-naphthyl-1)-p-chlorostyrylmethane;
bis(4-dimethylaminophenyl)-2'-methoxynaphthyl-1'-methane;
bis(4-dimethylaminophenyl)-4'-methoxynaphthyl-1'-methane;
bis(4-dimethylaminophenyl)-naphthyl-2'-methane;
bis(4-N-propylaminophenyl)-4'-propoxynaphthyl-2-methane;
bis(4-dimethylaminonaphthyl-1)-2'-pyridylmethane;
bis(4-dimethylaminonaphthyl-1)-2'-pyrazylmethane;
bis(4-dibenzylaminonaphthyl-1)-quinolin-3'-yl-methane;
etc.

(E) Diphenyl-β-styrylmethane-type chromogenic reactants:
bis(4-dimethylaminophenyl)-β-styrylmethane;
bis(3-methyl-4-N-phenylaminophenyl)-β-styrylmethane;
bis(4-N-benzyl-N-methylaminophenyl)-β-styrylmethane;
bis(4-dimethylaminophenyl)-β-(4'-dimethylaminostyryl)methane;
bis(4-dimethylaminophenyl)-β-(4'-methoxystyryl)methane;
bis(4-diethylaminophenyl)-β-(3'-methyl-4'-ethoxystyryl)methane;
bis(3-methyl-4-ethoxyphenyl)-β-(4'-diethylaminostyryl)-methane;
4-methylphenyl-4'-diethylaminophenyl-β-(3'-tert-butyl-4'-dimethylaminostyryl)-methane;
etc.

(F) Indolylmethane-type chromogenic reactants:
phenyl-bis(1-ethyl-2-methyl-indol-3-yl)methane;
4-methoxyphenyl-bis(1'-ethyl-2'-methylindol-3'-yl)methane;
3-methyl-4-methoxyphenyl-bis(1'-ethyl-2'-methylindol-3'-yl)methane;
3,4-dimethoxyphenyl-bis(1'-ethyl-2'-methylindol-3'-yl)methane;
2,4-dimethoxyphenyl-bis(1'-ethyl-2'-methylindol-3'-yl)methane;
3,4-diethoxyphenyl-bis(1'-ethyl-2-methylindol-3'-yl)methane;
3-butyl-4-methoxyphenyl-bis(1'-butyl-2'-methylindol-3'-yl)methane;
4-ethoxyphenyl-bis(1'-ethyl-2'-phenylindol-3'-yl)methane;
4-ethoxyphenyl-bis(1'-ethyl-2'-methylindol-3'-yl)methane;
phenyl-bis(1'-n-butyl-2'-methylindol-3'-yl)methane;
phenyl-bis(1'-methyl-2'-phenylindol-3'-yl)methane;
bis-(4-dimethylaminophenyl)-1'-ethyl-2'-methylindol-3'-yl)methane;
bis(1-ethyl-2-methylindol-3-yl)-2'-naphthylmethane;
bis(1-ethyl-2-methylindol-3-yl)-1'-naphtylmethane;
tris(1-ethyl-2-methylindol-3-yl)methane;

tris(1-n-butyl-2-methylindol-3-yl)methane;
bis(1-ethyl-2-methylindol-3-yl)-3'-chloro-4'-methoxyphenylmethane;
bis(1-propyl-2-phenylindol-3-yl)phenylmethane;
bis(1-octyl-2-methylindol-3-yl)phenylmethane;
bis(1-benzyl-2-methylindol-3-yl)phenylmethane;
bis(1-ethyl-2-methylindol-3-yl)-2'-methylphenylmethane;
bis(1-ethyl-2-methylindol-3-yl)-3'-methylphenylmethane;
bis(1-ethyl-2-methylindol-3-yl)-4'-methylphenylmethane;
bis(1-ethyl-2-methylindol-3-yl)-2'-methoxyphenylmethane;
bis(1-ethyl-2-methylindol-3-yl)-4'-fluorophenylmethane;
bis(1-ethyl-2-methylindol-3-yl)-4'-bromophenylmethane;
bis(1-hexylindol-3-yl)phenylmethane;
bis(1-ethyl-2-methylindol-3-yl)-3'-nitrophenylmethane;
bis(1-ethyl-2-methylindol-3-yl)-3',4'-dichlorophenylmethane;
bis(1-ethyl-2-methylindol-3-yl)-2'-thienylmethane;
bis(1-ethyl-2-methylindol-3-yl)-4'-methyl-2'-thienylmethane;
bis(1-butyl-2-methylindol-3-yl)-4'-pyridylmethane;
etc.

(F) Other leucomethine-type chromogenic reactants:
3,6-bis-dimethylamino-9-phenylxanthene;
3,6-bis-diethylamino-9-phenylxanthene;
3,6-bis-dimethylamino-9-(3'-methyl-4'-dimethylaminophenyl)xanthene;
3-diethylamino-6,7-dimethyl-9-phenylxanthene;
3,6-dimethoxy-9-(4'-dimethylaminophenyl)xanthene;
3,6-diethoxy-9-(4'-dimethyl-naphthyl-1')xanthene;
3,6-bis(N-methyl-N-phenylamino)-9-(3',4'-dimethoxyphenyl)xanthene;
3,6-bis-dimethylamino-9-phenylthioxanthene;
3,6-dimethylamino-9-(4'-methoxydiphenyl)-10-methyl-9,10-dihydroacridine;
3,6-bisdimethylamino-9-(4'-dimethylaminophenyl)fluorene;
etc.

It should however be borne in mind that the methine-type chromogenic reactant useful in the practice of this invention is not necessarily limited to the above-recited illustrative compounds.

On the other hand, the oxidizing organic compound useful in the practice of this invention means such an oxidizing organic compound that, when either one or both of the chromogenic reactant and oxidizing organic compound are molten owing to an application of heat thereto, it is brought into contact with the methine-type chromogenic reactant and oxidizes the methine-type chromogenic reactant, thereby providing a color image or mark with the thus-oxidized methine-type chromogenic reactant on the base. As preferred compounds, may be mentioned quinone derivatives which have oxidizing capacity and are practically insoluble in water. More preferably, may be mentioned water-insoluble quinone derivatives which have each been substituted by an electron-attractive group. Quinone derivatives substituted by an electron-attractive group, notably multi-substituted by a plurality of electron-attractive groups are compounds having high oxidation-reduction potentials and are of the most preferable compound forms.

Since these quinone derivatives are required to be present in a stable state on heat-insensitive recording paper, it is not preferred to use compounds having low molecular weights or those having sublimable property. More specifically, it is preferred to use benzoquinone derivatives represented by the general formula (II) or (III):

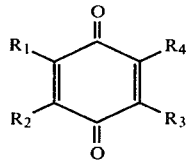

(II)

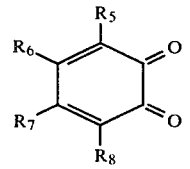

(III)

in which at least one of $R_1$–$R_8$ which are individually a halogen atom or a cyano, nitro, carboxyl, alkoxycarbonyl, aryloxycarbonyl, aralkyloxycarbonyl, alkylsulfonyl, arylsulfonyl, aralkylsulfonyl, alkoxysulfonyl, aryloxysulfonyl, aralkyloxysulfonyl or acyl group is contained as substituent group(s) in the molecule and the remaining substitutent group(s) is individually a hydrogen atom or an alkyl, aryl, aralkyl, alkoxy, allyloxy, aralkyloxy, alkylthio or arylthio group, and, where the adjacent carboxyl groups may form an imide ring.

As exemplary benzoquinone derivatives represented by the general formula (II) or (III), may be mentioned:
2,3-dicyano-5,6-dichloro-1,4-benzoquinone;
2,3,5,6-tetracyano-1,4-benzoquinone;
3,4-dibromo-5,6-dicyano-1,2-benzoquinone;
3,4,5,6-tetracyano-1,2-benzoquinone;
2,3,5,6-tetrabromo-1,4-benzoquinone;
2,3,5,6-tetraiodo-1,4-benzoquinone;
2,3,5,6-tetramethoxycarbonyl-1,4-benzoquinone;
2,3,5,6-tetraethoxycarbonyl-1,4-benzoquinone;
2,3,5,6-tetra-i-butoxycarbonyl-1,4-benzoquinone;
2,3,5,6-tetra-n-hexyloxycarbonyl-1,4-benzoquinone;
2,3,5,6-tetra-(2'-ethylhexyloxycarbonyl)-1,4-benzoquinone;
2,3,5,6-tetradodecyloxycarbonyl-1,4-benzoquinone;
2,3,5,6-tetraphenoxycarbonyl-1,4-benzoquinone;
2,3,5,6-tetra-p-toluyloxycarbonyl-1,4-benzoquinone;
2,3,5,6-tetrabenzyloxycarbonyl-1,4-benzoquinone;
2,3,5,6-tetranaphthoxycarbonyl-1,4-benzoquinone;
3,4,5,6-tetrapropyloxycarbonyl-1,2-benzoquinone;
3,4,5,6-tetra-n-butoxycarbonyl-1,2-benzoquinone;
2,5-dimethoxycarbonyl-3,6-dichloro-1,4-benzoquinone;
2,5-diethoxycarbonyl-3,6-dibromo-1,4-benzoquinone;
2,5-di-i-butoxycarbonyl-3,6-dibromo-1,4-benzoquinone;
2,5-di-n-octoxycarbonyl-3,6-dibromo-1,4-benzoquinone;
2,5-diphenoxycarbonyl-3,6-diiodo-1,4-benzoquinone;
2,5-dibenzyloxy-3,4-dichloro-1,2-benzoquinone;
3,6-di-n-pentyloxycarbonyl-3,4-dichloro-1,4-benzoquinone;
2,5-dibenzyloxycarbonyl-1,4-benzoquinone;
2,5-dibenzoyl-3,6-dichloro-1,4-benzoquinone;
2,5-dibenzoyl-3,6-dibromo-1,4-benzoquinone;
2,5-dibenzoyl-3-bromo-1,4-benzoquinone;

2,5-diacetyl-3,6-dibromo-1,4-benzoquinone;
2,5-diethoxycarbonyl-3,6-diphenylsulfonyl-1,4-benzoquinone;
2,5-di-n-butoxycarbonyl-3,6-di-4'-tolylsulfonyl-1,4-benzoquinone;
2,5-di-n-hexyloxycarbonyl-3,6-diphenylsulfonyl-1,4-benzoquinone;
2,5-di-propyloxycarbonyl-3,6-di-p-tolylsulfonyl-1,4-benzoquinone;
2,5-di-i-butoxycarbonyl-3,6-di-p-cyclohexylphenylsulfonyl-1,4-benzoquinone;
2,5-di-(2'-ethylheyloxycarbonyl)-3,6-di-4'-diphenylylsulfonyl-1,4-benzoquinone;
2,5-di-n-propyloxycarbonyl-3,6-di-4'-chlorophenylsulfonyl-1,4-benzoquinone;
2,5-diethoxycarbonyl-3,6-di-4'-methoxyphenylsulfonyl-1,4-benzoquinone;
2,5-di-benzyloxycarbonyl-3,6-di-4'-tolylsulfonyl-1,4-benzoquinone;
2,5-di-n-octyloxycarbonyl-3,6-diethylsulfonyl-1,4-benzoquinone;
2,5-diethoxycarbonyl-3,6-(2'-naphthylsulfonyl)-1,4-benzoquinone;
2,5-dimethoxycarbonyl-3-toluylsulfonyl-1,4-benzoquinone;
3,6-diethoxycarbonyl-4,5-diphenylsulfonyl-1,2-benzoquinone;
2,3,5,6-tetra-4'-toluylsulfonyl-1,4-benzoquinone;
2,3,5,6-tetraphenylsulfonyl-1,4-benzoquinone;
2,3,5,6-tetraethylsulfonyl-1,4-benzoquinone;
3,4,5,6-tetra-i-butylsulfonyl-1,2-benzoquinone;
2,3,5,6-tetra-n-octylsulfonyl-1,4-benzoquinone;
2,3,5,6-tetrabenzyloxysulfonyl-1,4-benzoquinone;
2,5-di-n-propyloxycarbonyl-3,6-dibenzoyl-1,4-benzoquinone;
2,5-di-i-butoxycarbonyl-3-benzoyl-1,4-benzoquinone;
2,3-dichloro-1,4-benzoquinone-5,6-dicarboxylic butylimide;
1,4-benzoquinone-2,3,5,6-tetracarboxylic diphenylimide;
1,2-benzoquinone-3,4,5,6-tetracarboxylic di-n-octylimide;
2,5-diethoxysulfonyl-1,4-benzoquinone;
2,5-diphenoxysulfonyl-3,6-dichloro-1,4-benzoquinone;
2,5-di-n-butoxycarbonyl-3,6-dibutoxysulfonyl-1,4-benzoquinone;
2,5-di-p-toluylsulfonyl-3,6-dibromo-1,4-benzoquinone;
2,5-di-n-hexylsulfonyl-3,6-dichloro-1,4-benzoquinone;
2,5-dibenzoyl-1,4-benzoquinone;
2,5-di(4'-methylbenzoyl)-1,4-benzoquinone;
2,5-di(4'-ethylbenzoyl)-1,4-benzoquinone;
2,5-di(3',4'-dimethylbenzoyl)-1,4-benzoquinone;
2,5-di(4'-chlorobenzoyl)-1,4-benzoquinone;
2,5-di(p-bromobenzoyl)-1,4-benzoquinone;
2,5-di(2',5'-dichlorobenzoyl)-1,4-benzoquinone;
etc.

Among the above-described benzoquinone derivatives, 2,5-dibenzoyl-1,4-benzoquinone derivatives represented by the general formula (IV):

(IV)

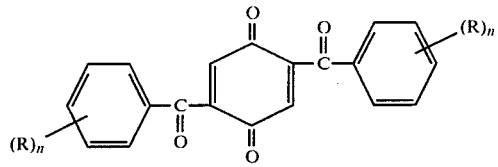

wherein R means a hydrogen or halogen atom or a lower alkyl group, and n stands for an integer up to 3 are particularly preferred due to their excellent storage stability, light resistant stability and anti-solvent stability. 2,5-Dibenzoyl-1,4-benzoquinone is the most suitable compound because its raw materials are easy to obtain and are easy to handle during its synthesis.

Even if a quinone derivative has great oxidizing capacity and has been substituted by one or more electron-attractive groups, the quinone derivative such as 2,3,5,6-tetrachloro-1,4-benzoquinone(Chloroanil), 2,3,5,6-tetrafluoro-1,4-benzoquinone(Fluoroanil),2,3,5-trichloro-1,4-benzoquinone, dichlorobenzoquinone, difluorobenzoquinone, etc, cannot be used as is for the following reasons where it has a small molecular weight and is sublimable:

(1) It undergoes gradual sublimation from the heat-sensitive recording paper during its storage and the color-producing capacity of the heat-sensitive recording paper is thus lowered;

(2) The thus-sublimated quinone derivative reacts with the methine-type chromogenic reactant, thereby causing the heat-sensitive recording paper to show an undesired or inconvenient color which is the thus-oxidized methine-type chromogenic reactant; and (3) The working environment is adversely affected. Accordingly, it is necessary to use some sublimation-suppressing means if one wants to employ such a quinone derivative as is.

The methine-type chromogenic reactant useful in the practice of this invention and represented by the general formula (I) is generally unstable to its storage and, in many instances, tends to show such tendency that it considerably colors an aqueous suspension, aqueous coating formulation or the coated surface of a heat-sensitive recording paper respectively in its dispersion step in a liquid (i.e., the step to convert the methine-type chromogenic reactant to the aqueous suspension in which the reactant is present as fine particles), in the preparation step of the methine-type chromogenic reactant together with a color-developing agent and other additives into the aqueous coating formulation or in the coating step of the aqueous coating formulation on a base to prepare the heat-sensitive recording paper; and the resulting heat-sensitive recording paper is colored during its storage or upon exposure to light. Therefore, the methine-type chromogenic reactant may lack utility, in some instances, in the production of heat-sensitive recording paper if it is used as is.

Accordingly, it is preferred to use (A) a quaternary ammonium salt, (B) an alkanol amine having a tertiary amino group or (C) a water-soluble metal ion sequestering agent along with the methine-type chromogenic reactant and oxidizing organic compound which are basically essential in the present invention.

As exemplary quaternary ammonium salts(A), may be mentioned specifically:
lauryltrimethylammonium chloride;

stearyltrimethylammonium chloride;
distearyldimethylammonium chloride;
dodecyltrimethylammonium chloride;
octadecyltrimethylammonium chloride;
tetradecyldimethylbenzylammonium chloride;
etc.

As specific examples of the alkanol amines containing a tertiary amine(B), may be mentioned:
tris-N-(2-hydroxyethyl)amine;
tris-N-(2-hydroxypropyl)amine;
tris-N-(3-hydroxypropyl)amine;
tris-N-(hydroxydibutyl)amine;
N,N-dimethyl-N-(2-hydroxyethyl)amine;
N,N-diethyl-N-(2-hydroxyethyl)amine;
N,N-dipropyl-N-(2-hydroxyethyl)amine;
N,N-dibutyl-N-(2-hydroxyethyl)amine;
N-methyl-N-phenyl-N-(2-hydroxyethyl)amine;
N,N-diphenyl-N-(2-hydroxyethyl)amine;
N,N-dimethyl-N-(2-hydroxypropyl)amine;
N,N-diethyl-N-(2-hydroxypropyl)amine;
N,N-dipropyl-N-(2-hydroxypropyl)amine;
N,N-dibutyl-N-(2-hydroxypropyl)amine;
N,N-diphenyl-N-(2-hydroxypropyl)amine;
N-methyl-N,N-di(2-hydroxyethyl)amine;
N-ethyl-N,N-di(2-hydroxyethyl)amine;
N-phenyl-N,N-di(2-hydroxyethyl)amine;
N-methyl-N,N-di(2-hydroxypropyl)amine;
N-acetyl-N,N-di(2-hydroxyethyl)amine;
N-methyl-N,N-di(2-hydroxypropyl)amine;
N-acetyl-N,N-di(2-hydroxyethyl)amine;
N-acetyl-N,N-di(2-hydroxypropyl)amine;
N-hydroxyethylmorpholine;
N-hydroxypropylmorpholine;
N-tetradecyl-N,N-di(ω-hydroxyethylpolyoxyethylene)amine
N-dodecyl-N,N-di(ω-hydroxyethylpolyoxyethylene)amine;
N-octadecyl-N,N-di(ω-hydroxyethylpolyoxyethylene)amine;
N,N-didodecyl-N-(ω-hydroxyethylpolyoxyethylene)amine;
N,N-di(cis-octadecenyl)-N-(ω-hydroxyethylpolyoxyethylene)amine;
N,N-dioctadecyl-N-(ω-hydroxyethylpolyoxyethylene)amine;
compounds formed by adding alkylene dioxides to aliphatic diamines, for example, those represented by the following structural formula:

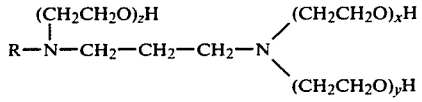

wherein R is an aliphatic chain and x, y and z are each a positive integer;
N,N-ω-hydroxyalkylpolyoxyalkylene-substituted aliphatic amides, for example, those represented by the following structural formula:

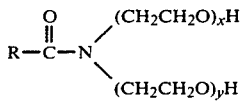

wherein R means an aliphatic chain and x and y stand individually for a positive integer;
reaction products between ammonia and glycidols(2-amino-propylene glycol derivatives);
etc.

The metal ion sequestering agent(C) is bonded with multi-valent metal ions present in a system dispersing the chromogenic reactant, i.e., the layer of the chromogenic reactant applied on the base of a heat-sensitive recording paper so as to form a stable chelate compound, thereby retarding the inconvenient coloring tendency of the methine-type chromogenic reactant in the presence of such multivalent metal ions. As metal ion sequestering agents having such an effect, may for example be mentioned water-soluble metal ion sequestering agents such as ethylenediaminotetraacetic acid, N-hydroxyethyl-ethylenediamine-N,N',N'-triacetic acid, diethylenetriamine-pentaacetic acid, triethylenetetramminepentaacetic acid, nitrilotriacetic acid, N-hydroxyethyliminodiacetic acid, diethanol glycin, ethylenediamine-N,N'-diacetic acid, glycoletherdiaminetetraacetic acid, 1,3-diaminopropan-2-ol-tetraacetic acid, tartaric acid, citric acid, gluconic acid and saccharic acid, and their alkali metal salts, salts of polyacrylic acid, and metal salts of ligninsulfonic acid.

These coloration-inhibitory additives may be used in an amount of 0.1–1000 parts by weight per 100 parts by weight of the methine-type chromogenic reactant. Among these additives, the water-soluble quaternary ammonium salt (A) can bring about the greatest effect when used even in a relatively small amount.

The heat-sensitive recording unit according to this invention is basically formed of a methine-type chromogenic reactant and oxidizing organic compound, both supported as mutually-isolated fine particles on a base. Accordingly, the production of a color by the reaction between the methine-type chromogenic reactant and oxidizing organic compound is allowed to take place upon application of heat energy that raises either one or both of the methine-type chromogenic reactant and oxidizing organic compound to its melting point or other respective melting points. Therefore, it is required to have heat-sensitive recording paper produce its color at an elevated temperature where the chromogenic reactant and/or oxidizing organic compound, notably, the oxidizing organic compound is a high m.p. compound. Consequently, a heavy load is applied to thermal heads or heat pens which are used as sources for supplying thermal energy. Such heat-sensitive recording paper can hardly meet the high-speed printing. It is thus preferred to adjust the color-producing temperature characteristics by using a color production sensitivity regulator in combination.

In the case of high m.p. compounds such as benzoquinone derivatives which are particularly-preferred oxidizing organic compounds, for example, 2,5-dibenzoyl-1,4-benzoquinones, it is preferred to use a color production temperature adjusting agent in combination.

As such color production sensitivity regulators, there are employed compounds which have melting points in the range of 70°–150° C. and, when molten, dissolve the methine-type chromogenic reactant and/or oxidizing organic compound. As specific compounds, may for example be mentioned as follows:

(1) Higher fatty acid amides and their derivatives, for example, stearic acid amide, linoleic acid amide, myristic acid amide and oleic acid amide and their methylol derivatives, methylene-bis-stearoamide, and ethylene-bis-stearoamide;

(2) alkylbiphenyls, alkylnaphthalenes and biphenylalkanes, e.g., 4,4'-dimethylbiphenyl, 2,6-diisopropylnaphthalene, etc.;

(3) ketones, for example, diundecyl ketone, diheptadecyl ketone, etc.;

(4) Carboxylic and sulfonic acid esters of phenol derivatives, for example, diphenyl propionate, diphenyl cyclohexylcarboxylate, diphenyl phenylsulfonate, diphenyl benzoate, 2-naphthyl benzoate, p-cyclohexylphenyl benzoate, p-cyclohexylphenyl p-toluenesulfonate, p-cyclohexylphenyl cinnamate, p-tert-butylphenyl benzoate, p-tert-octylphenyl benzoate, p-acetylphenyl benzoate, resorsine dibenzoate, 4,4'-thiobisphenol dibenzoate, bis-phenol A-di(phenylsulfonate), phenyl-p-toluenesulfonate, p-tert-butylphenyl-p-toluenesulfonate, diphenyl isophthalate, di-p-sec-butylphenyl isophthalate, di(o-cyclohexylphenyl)isophthalate, di(o-octoxycarbonylphenyl)isophthalate, di(p-sec-butylphenyl)terephthalate, di(o-sec-butylphenyl)terephthalate, and o-phenoxycarbonylphenyl benzoate;

(5) N-phenylsulfonamide derivatives, for example, N-phenylbenzenesulfonamide, 4-methyl-N-phenylbenzenesulfonamide, etc.;

(6) aromatic ethers, for example, naphthyl phenyl ether;

(7) Aromatic acid amides, for example, benzoic acid N-cyclohexylamide;

(8) Aromatic carboxylic acid esters, for example, dimethyl terephthalate; and (9) Others, including compounds represented by

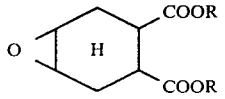

wherein R means a long-chain alkyl group. Needless to say, the color production sensitivity regulator is not limited to the above compounds which are merely illustrative.

Among the above-described compounds, the carboxylic and sulfonic acid esters of phenol derivatives(4) and the N-phenylsulfonamide derivatives(5) are most effective as color production sensitivity regulators in heat-sensitive recording units according to this invention, which units are of the oxidation color production type. These sensitivity regulators may be suitably selected in accordance with the desired temperature and printing speed characteristics of each heat-sensitive recording paper. The regulator may generally be used in an amount of 10–500 parts by weight per every 100 parts by weight of a color-developing agent. Similar to the chromogenic reactant and color-developing agent, it is preferred to form the color production sensitivity regulator as fine particles into an aqueous suspension in the presence of a dispersant prior to its application.

The usual production process of heat-sensitive recording paper making use of the novel heat-sensitive recording unit according to this invention will next be described.

The methine-type chromogenic reactant represented by the general formula (I), oxidizing organic compound, preferably a benzoquinone derivative represented by the general formula (II), and, if necesssary, a color production sensitivity regulator are separately dispersed as fine particles in the presence of a surfactant or protective colloidal substance in water or an organic solvent. As such a surfactant or protective colloidal substance, may be mentioned polyvinyl alcohol, carboxymethylcellulose, hydroxyethylcellulose, methylcellulose, hydroxycellulose, polyvinyl pyrrolidone, modified polyvinyl alcohol, gum arabi, gelatin, a high-molecular anionic surfactant, a natural gum or the like.

These methine-type chromogenic reactant dispersion (A), color-developing agent dispersion(B) and, if necessary, color production sensitivity regulator dispersion(C) are then mixed, followed by further mixing with the above-mentioned various additives for controlling the physical properties of the surface of a heat-sensitive recording paper to be produced. A coating formulation has thus been prepared. It is also feasible to use, in order to adjust the coatability of the coating formulation and the physical properties of heat-sensitive recording paper to be produced, an inorganic or organic pigment such as kaolin, calcined kaolin, talc, titanium oxide, calcium carbonate, zinc oxide, aluminum hydroxide, silica, diatonaceous earth, urea-formaldehyde resin-or polystyrene microbeads; a lubricant, for example, an animal wax such as bees wax or shellac, vegetable wax such as carnauba wax, synthetic wax such as petroleum wax, microcrystalline wax or polyethylene wax, or metal soap (metal salt of higher fatty acid) such as calcium stearate or zinc stearate; a pressure color production inhibitor; a binder; a surfactant; a defoaming agent; and the like as needed.

In order to apply the thus-prepared coating formulation, a variety of coating methods which are known per se in the art may be employed, including for example the bar coating method, air-knife coating method, gravure coating method, flexocoating method, blade coating method, roller coating method, etc. It is also feasible to incorporate the coating formulation in paper upon making the paper. It should be borne in mind that the above mixing method and coating method do not limit the production process of heat-sensitive recording paper which makes use of the unit according to this invention. Thus, it is possible to employ a variety of coat forms. For example, the chromogenic reactant and benzoquinone derivative may be coated respectively as separate layers. Alternatively, it may be possible to apply an overcoat or undercoat layer made of a water-soluble polymer material over the upper or lower surface of a heat-sensitive recording layer so as to enhance the stability of the environment further.

The general coat weight of the heat-sensitive layer is at least 0.5 g/m$^2$, and preferably 1–10 g/m$^2$ when measured as a dry coat weight. The relative proportions of various components making up each heat-sensitive recording sheet may be as follows:

| | |
|---|---|
| Methine-type chromogenic reactant | 0.5–5 wt. %<br>Preferably, 1–3 wt. % |
| Oxidizing organic compound | 2–15 wt. %, preferably, 4–10 wt. %. |
| Color production sensitivity regulator | 0–20 wt. % |

The coat weights of both chromogenic reactant and oxidizing organic compound are individually as little as 1/5–⅓ of the phthalide-type compound and acidic phenolic color-developing agent which are used most extensively these days as main components in heat-sensitive recording paper. Therefore, the heat-sensitive recording paper according to this invention are extremely advantageous from both industrial and economical viewpoints.

The heat-sensitive recording unit, which makes use of the thus-obtained novel color production system, enjoys the following merits compared with conventional chromogenic reactant based color production-type heat-sensitive recording paper which relies upon a color production reaction between a phthalide-type or fluoran-type chromogenic reactant and a phenolic compound:

(1) The amounts of a chromogenic reactant and color-developing agent, which are applied on a base, have been reduced to significant extents and there is no need to use the color-developing agent in any large excess;

(2) Since the energy required to produce a color has been reduced considerably, it is possible to save energy. Besides, it is feasible to meet the speed-up of the heat-sensitive recording system, thereby being successfully adopted in the high-speed facsimile system;

(3) Resulting color images or marks feature excellent storage stability. They do not disappear at all by their contact with organic solvents. They do not disappear even when brought into contact with water; and (4) Resulting color images or marks enjoy excellent fastness to light.

Due to the above-mentioned merits, the heat-sensitive recording paper according to this invention is extremely useful for POS bar code food labels which have a big chance to contact with edible oil, plasticizer contained in PVC wrapping films, oils and fats contained in foods and plasticizer present in PVC sheets and in application fields requiring strong storage stability such as commuting passes, to say nothing of facsimiles and other printers.

The present invention will hereinafter be described in further detail by the following examples.

EXAMPLE 1

| | |
|---|---|
| (A) 2,5-dibenzoyl-1,4-benzoquinone (m.p. 232-235° C.) | 10 g |
| 10% polyvinyl alcohol | 20 g |
| water | 20 g |
| TOTAL | 50 g |
| (B) 4,4',4''-tris-dimethylamino-phenyl-methane (Leuco Crystal Violet) | 10 g |
| 10% polyvinyl alcohol | 20 g |
| triethanolamine | 1 g |
| water | 19 g |
| TOTAL | 50 g |

The compositions (A) and (B) were separately wet-ground in sand grinding mills to form aqueous suspensions. Using these aqueous suspensions, a 20% aqueous coating formulation having the following composition was prepared.

| | Weight ratio (solid matter) |
|---|---|
| 2,5-dibenzoyl-1,4-benzoquinone | 5 |
| Leuco Crystal Violet | 2 |
| calcium carbonate | 53 |
| stearic acid amide | 10 |
| polyvinyl alcohol | 20 |

The coating formulation was then applied by a Meyer bar coater onto a base paper web of 70 g/m$^2$ to give the dry coat weight of 6 g/m$^2$, followed by its drying to obtain a heat-sensitive recording paper. The heat-sensitive recording paper was caused to produce its color by using a commercial thermal printer, thereby obtaining prints of deep bluish purple. A plasticizer (dioctylphthalate) was dropped on the thus-printed proportions. The prints did not show any tendency of fading out and non-printed portions were not observed to develop any color. The printed portions did not tend to disappear or become thinner during its storage. The heat-sensitive recording paper was thus excellent in overall storage stability.

EXAMPLE 2

A heat-sensitive recording paper was obtained in the same manner as in Example 1 except that wet-ground fine N-phenyl-p-toluenesulfonamide particles (m.p. 96°-98° C.) was used in place of stearic acid amide in the same amount. The heat-sensitive recording paper of the present Example was printed using a G-II model heat-sensitive facsimile machine ("OKIFAX 5800" manufactured by Oki Electric Industry Co., Ltd.). Deep bluish purple prints were obtained. The thus-produced color prints were extremely stable as in Example 1.

EXAMPLES 3-7

Aqueous suspensions having the following composition were respectively prepared using as their chromogenic reactants 4,4'-bis(dimethylamino)-3''-cyclohexyl-4''-methoxytriphenylmethane, 4,4'-bis(dimethylamino-phenyl)-4''-methoxynaphthyl-1'-methane, 4,4'-bismorpholino-3'-tert-butyl-4''-methoxytriphenylmethane, bis(4-dimethylaminophenyl)-β-styrylmethane and b 4,4'-dimethoxy-4''-dimethylaminotriphenylmethane and processing them in attritors.

| | |
|---|---|
| (A) chromogenic reactant | 10 g |
| 10% aqueous solution of hydroxyethylcellulose | 20 g |
| aqueous solution of stearyl-trimethylammonium chloride | 1 g |
| water | 19 g |
| TOTAL | 50 g |

Using each of the above-obtained aqueous suspension, the same aqueous suspension of the color-developing agent as prepared in Example 1(B) and an aqueous suspension of o-phenoxycarbonylphenyl (m.p. 82°-85° C.) (C) prepared on the side, a 20% aqueous coating formulation having the following composition was prepared.

| | Weight ratio (solid matter) |
|---|---|
| 2,5-dibenzoyl-1,4-benzoquinone | 7 |
| chromogenic reactant | 2 |
| talc | 30 |
| calcium carbonate | 20 |
| zinc stearate | 5 |
| color production sensitivity regulator | 15 |
| hydroxyethylcellulose | 20 |

The above coating formulation was then applied to a base paper web of 50 g/m$^2$ to give a coat weight of 6 g/m$^2$, thereby obtaining a heat-sensitive recording paper.

EXAMPLE 8

The procedures of Example 3 were followed to give a heat-sensitive recording paper having the following composition:

| | |
|---|---|
| color-developing agent [2,5-di(p-methylbenzoyl)-1,4-benzoquinone] | 5 |
| chromogenic reactant [3,3'-dimethyl-4,4'-bis(methylamino)-4''-dimethyl-aminotriphenylmethane] | 3 |
| calcined kaolin | 30 |
| precipitated calcium carbonate | 22 |
| zinc stearate | 5 |
| color production sensitivity regulator (resorcine benzoate) | 10 |
| hydroxyethylcellulose | 25 |
| TOTAL | 100 |

The heat-sensitive recording paper of the present Example gave deep bluish purple prints when printed by a commercial thermal printer.

EXAMPLE 9

A heat-sensitive recording paper was obtained in the same manner as in Example 1 except that the color-developing agent and chromogenic reactant were changed to the following ones:

| | |
|---|---|
| color-developing agent | 2,5-di-i-butoxycarbonyl-3,6-di(p-tolylsulfonyl)-1,4-benzoquinone |
| chromogenic reactant | bis(4-methylamino-3-methyl-phenyl)-(4'-methoxystyryl)-methane (30 wt. %); bis(1-ethyl-2-methyl-indol-3-yl)-4'-dimethylaminophenylmethane (20 wt. %); and bis(1-ethyl-2-methyl-indol-3-yl)-4'-ethoxyphenylmethane (50 wt. %). Used as a mixture. |

The heat-sensitive recording paper of the present Example produced a deep black color when kept for 5 seconds in contact with a hot plate of 200° C. The thus-produced color mark did not show at all any tendency to fade out even when brought into contact with plasticizers, oil, fat and the like.

EXAMPLES 10–13

Heat-sensitive recording papers were obtained, following the procedures of Example 2 except that the following color-developing agents were used respectively. All the heat-sensitive recording papers were printed by a G-II model facsimile machine. They all gave deep bluish purple prints. Densities of color which had respectively been obtained by keeping the above heat-sensitive recording papers in contact for 5 seconds with hot plates of 200° C. were also measured. Results are summarized in Table 1.

TABLE 1

| Example | Color-developing agent | Density of produced color |
|---|---|---|
| 10 | 2,3,5,6-tetraethoxycarbonyl-1,4-benzoquinone | 1.42 |
| 11 | 2,5-di-n-butylsulfonyl-3,6-diethylcarbonyl-1,4-benzoquinone | 1.41 |
| 12 | 2,5-diphenylsulfonyl-3,6-di-i-butoxycarbonyl-1,4-benzoquinone | 1.38 |
| 13 | 2,5-dibromo-3,6-di-cyclohexyl-oxycarbonyl-1,4-benzoquinone | 1.39 |

All the heat-sensitive recording papers exhibited good stability with respect to their respective color images.

COMPARATIVE EXAMPLE 1

Bisphenol A and Crystal Violet Lactone were respectively wet-ground into fine particles and then formed into aqueous suspensions in the same manner as in Example 1.

Using the above aqueous suspensions, an aqueous coating formulation having the following composition was prepared.

| | Weight parts (solid matter) |
|---|---|
| bisphenol A | 20 |
| Crystal Violet Lactone | 8 |
| stearic acid amide | 20 |
| calcium carbonate | 32 |
| polyvinyl alcohol | 20 |

The above aqueous coating formulation was applied on a base paper web of 70 g/m$^2$ to give the dry coat weight of 7 g/m$^2$, followed by its drying to obtain a heat-sensitive recording paper. The heat-sensitive recording paper produced a deep bluish purple color when printed by a thermal printer. Printed portions were brought into contact with dioctyl phthalate. The color image disappeared immediately and became illegible.

COMPARATIVE EXAMPLE 2

Benzyl p-oxybenzoate and 3-diethylamino-6-methyl-7-anilinofluoran were respectively wet-ground into fine particles and the converted into aqueous suspensions in the same manner as in Example 1.

Using these aqueous suspensions, an aqueous coating formulation having the following composition was prepared.

| | Weight parts (solid matter) |
|---|---|
| benzyl p-oxybenzoate | 20 |
| 3-diethylamino-6-methyl-7-anilinofluoran | 9 |
| zinc stearate | 10 |
| talc | 41 |
| polyvinyl alcohol | 20 |

The above aqueous coating formulation was applied on a base paper web of 70 g/m$^2$ to give the coat weight of 7 g/m$^2$. The heat-sensitive recording paper of the present Comparative Example produced a deep black color when printed by a G-II model facsimile machine. When cotton seed oil was brought into contact with the thus-printed portions, the black disappeared immediately and became illegible. The thus-printed paper was stored at a dark place in a room. It showed the tendency of natural fading. The color images or marks, produced on the heat-sensitive recording paper, were generally poor in stability.

REFERENTIAL EXAMPLE 1

Each of the heat-sensitive recording papers of Examples 1 and 2 was caused to produce its color by keeping it in contact with a metal block having the temperature gradient of 60° C.-200° C., for 5 seconds and under the pressure of 10 g/cm$^2$, using Thermotest Rhodiaceta (Model 7401; manufactured by SETARAM Corporation). Upon an elapsed time of 10 minutes, the relationship between the color densities and color production temperatures was studied using a Macbeth densitometer (visible filter). A higher color density indicated a deeper color. Results are summarized in Table 2.

TABLE 2

| Color production temperature (°C.) | 60 | 70 | 80 | 85 | 90 | 95 | 100 | 110 | 120 | 130 | 140 | 150 | 160 |
|---|---|---|---|---|---|---|---|---|---|---|---|---|---|
| Example 1 | 0.06 | 0.06 | 0.10 | 0.20 | 0.28 | 0.35 | 0.42 | 0.57 | 0.71 | 0.86 | 1.00 | 1.12 | 1.20 |
| Example 2 | 0.06 | 0.06 | 0.10 | 0.21 | 0.40 | 0.60 | 0.83 | 1.20 | 1.31 | 1.35 | 1.35 | 1.35 | 1.35 |

REFERENTIAL EXAMPLE 2

Each of the heat-sensitive recording papers of Examples 1 and 3-7 was kept for 5 seconds in contact with a metal block having the surface temperature of 200° C. to produce a color thereon. Furthermore, it was subjected to POS(point of sales) bar code printing, using a desk-top bar code label printer (Model BP-70; manufactured by Teraoka Seiko K.K.). The heat-sensitive recording papers produced marks of the corresponding colors respectively. Anti-ester property and storage stability tests were carried out on the marks per se, which were produced by the metal blocks, and the recording papers bearing the marks respectively. Test results are shown in Table 3:

TABLE 3

| Ex. | Color density (hue) | Anti-ester property* | Storage stability** |
|---|---|---|---|
| 1 | 1.41 (bluish purple) | 1.42 | 1.41 |
| 3 | 1.38 (deep green) | 1.38 | 1.38 |
| 4 | 1.21 (dark blue) | 1.25 | 1.21 |
| 5 | 1.35 (deep green) | 1.36 | 1.35 |
| 6 | 1.33 (dark green) | 1.34 | 1.33 |
| 7 | 1.38 (red) | 1.36 | 1.38 |

Note:
*Each of the marked papers was brought into contiguous relation with a paper file made of soft polyvinyl chloride ("Richt Clear Pocket") and then kept for 24 hours and at 60° C. in a constant-temperature chamber while maintianing the load of 1 kg per 0.01 m$^2$. Thus, the marked paper was kept in contact with a plasticizer (ester) present in the polyvinyl chloride. The extent of fading of the mark was measured.
**Storage stability test: Each marked paper was stored at a dark place for 6 months to investigate any change in the density of the produced color.

We claim:

1. A heat-sensitive recording unit comprising (a) a methine-type chromogenic reactant represented by the formula

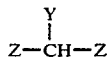

wherein X, Y and Z are the same or different and individually are a substituted or unsubstituted phenyl, naphthyl, β-styryl or aromatic heterocyclic residual group, two of X, Y and Z may be coupled together to form a ring, and the substituted or unsubstituted phenyl, naphtyl or β-styryl group has at least one amino, substituted amino or lower alkoxyl group at the para-position relative to the central methine group of the molecule when one or none of X, Y and Z is the aromatic heterocyclic residual group, (b) an oxidizing organic compound selected from unsublimable and water-insoluble benzoquinone derivatives substituted with an electron-attractive group, and (c) a color production sensitivity regulator which has a melting point of from 70° C. to 150° C. and, when molten, dissolves the chromogenic reactant and/or the oxidizing organic compound, the components (a), (b) and (c) being supported on a substrate.

2. A heat-sensitive recording unit according to claim 1, wherein the oxidizing organic compound is a 2,5-dibenzoyl-1,4-benzoquinone derivative represented by the general formula:

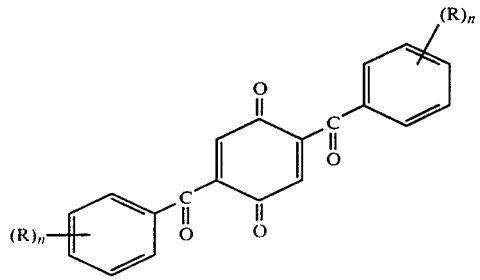

wherein R denotes a hydrogen or halogen atom or a lower alkyl group and n stands for an integer of 3 or smaller.

3. A heat-sensitive recording unit according to claim 1, wherein the color production sensitivity regulator is the carboxylic or sulfonic acid ester of a phenol derivative or an N-phenylsulfonamide derivative.

4. A heat-sensitive recording unit according to claim 1, wherein at least one additive selected from the group consisting of a water-soluble quaternary ammonium salt, tertiary alkanol amine and water-soluble ion sequestering agent is further supported on the base.

5. A heat-sensitive recording unit according to claim 4, wherein the at least one additive is incorporated upon forming the methine-type chromogenic reactant into an aqueous suspension in order to support the methine-type chromogenic reactant on the base.

6. A heat-sensitive recording unit according to claim 5, wherein the at least one additive is the water-soluble quaternary ammonium salt.

7. A heat-sensitive recording unit according to claim 1, wherein at least one additive selected from the group consisting of a water-soluble quaternary ammonium salt, tertiary alkanol amine and water-soluble ion sequestering agent is further supported on the base.

8. A heat-sensitive recording unit according to claim 7, wherein the at least one additive is incorporated upon forming the methine-type chromogenic reactant into an aqueous suspension in order to support the methine-type chromogenic reactant on the base.

9. A heat-sensitive recording unit accordance to claim 8, wherein the at least one additive is the water-soluble quaternary ammonium salt.

10. A heat-sensitive recording unit according to claim 1, wherein the amount of the color production sensitivity regulator is in the range of from 10 to 500 parts by weight per 100 parts by weight of the oxidizing organic compound.

* * * * *